US011859893B2

(12) United States Patent
Jeong et al.

(10) Patent No.: US 11,859,893 B2
(45) Date of Patent: Jan. 2, 2024

(54) REFRIGERATOR

(71) Applicant: SAMSUNG ELECTRONICS CO., LTD., Suwon-si (KR)

(72) Inventors: Jin Jeong, Suwon-si (KR); Kyoungki Park, Suwon-si (KR); Kwanyeol Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 342 days.

(21) Appl. No.: 16/951,196

(22) Filed: Nov. 18, 2020

(65) Prior Publication Data

US 2021/0148623 A1 May 20, 2021

(30) Foreign Application Priority Data

Nov. 19, 2019 (KR) ..... 10-2019-0148912

(51) Int. Cl.
*F25C 1/10* (2006.01)
*F25C 5/04* (2006.01)
(Continued)

(52) U.S. Cl.
CPC ..... *F25D 17/065* (2013.01); *F25C 1/10* (2013.01); *F25C 1/24* (2013.01); *F25C 5/04* (2013.01);
(Continued)

(58) Field of Classification Search
CPC ..... F25C 1/10; F25C 5/04; F25C 2305/0221; F25C 5/06; F25C 2700/12; F25C 1/24;
(Continued)

(56) References Cited

U.S. PATENT DOCUMENTS 3,182,464 A * 5/1965 Archer ..... F25C 1/04 177/116
7,654,105 B2 * 2/2010 Lee ..... F25C 1/04 62/344
(Continued)

FOREIGN PATENT DOCUMENTS

DE 102008044178 A1 * 6/2010 ..... F25C 1/04
EP 1580504 A2 * 9/2005 ..... F25C 5/22
(Continued)

OTHER PUBLICATIONS

KR 101677377B1, machine translation (Year: 2023).*
(Continued)

*Primary Examiner* — Len Tran
*Assistant Examiner* — Kirstin U Oswald
(74) *Attorney, Agent, or Firm* — STAAS & HALSEY LLP

(57) ABSTRACT

A refrigerator including a main body having a refrigerating compartment and a freezing compartment, a refrigerating compartment door rotatably coupled to the main body to open and close at least a part of the refrigerating compartment, an ice-making compartment, an ice maker disposed in the ice-making compartment to make ice, a dispenser to dispense ice, an auxiliary door to open and close the ice-making compartment, and a cold air duct connecting the ice-making compartment to the freezing compartment to cool the ice-making compartment. The ice maker including an ice-making tray that is rotatable and a cold air guide that is deformable and restorable and fixed to the ice-making tray.

17 Claims, 11 Drawing Sheets

(51) Int. Cl.
*F25D 23/02* (2006.01)
*F25D 17/06* (2006.01)
*F25C 5/06* (2006.01)
*F25C 1/24* (2018.01)

(52) U.S. Cl.
CPC ..... *F25C 5/06* (2013.01); *F25D 23/028* (2013.01); *F25C 2305/0221* (2021.08)

(58) Field of Classification Search
CPC .. F25C 2400/10; F25D 23/028; F25D 29/005; F25D 23/025; F25D 2317/061; F25D 2317/062; F25D 2317/063; F25D 2317/0666; F25D 17/065; F25D 11/02; F25D 17/08; F25D 31/002; F25D 2700/121
USPC ..... 62/340
See application file for complete search history.

(56) References Cited

U.S. PATENT DOCUMENTS 8,973,391 B2* 3/2015 Lee ..... F25C 5/20 62/340
11,073,320 B2 7/2021 Alshourbagy et al.
2004/0237565 A1* 12/2004 Lee ..... F25C 5/046 62/340
2005/0061016 A1* 3/2005 Lee ..... F25C 5/046 62/340
2005/0061018 A1* 3/2005 Kim ..... F25D 17/065 62/340
2005/0210909 A1* 9/2005 Kim ..... F25D 23/12 62/340
2005/0252232 A1* 11/2005 Lee ..... F25D 23/04 62/340
2008/0034779 A1* 2/2008 Lee ..... F25C 1/04 62/344
2008/0034780 A1* 2/2008 Lim ..... F25C 1/04 62/353
2008/0264082 A1* 10/2008 Tikhonov ..... F25C 1/04 62/425
2010/0257877 A1* 10/2010 Yun ..... F25D 17/065 62/340
2011/0239687 A1* 10/2011 Lim ..... F25D 23/025 62/340
2012/0102997 A1* 5/2012 Oh ..... F25C 5/06 62/340
2013/0152617 A1* 6/2013 Oh ..... F25C 1/24 62/340
2013/0167574 A1* 7/2013 Yoon ..... F25C 1/24 62/340
2013/0199233 A1* 8/2013 Coulter ..... F25D 11/02 29/890.035
2014/0182315 A1* 7/2014 Kim ..... F25C 5/187 62/73
2016/0370049 A1* 12/2016 Yang ..... F25D 17/065
2017/0074572 A1* 3/2017 Visin ..... F25D 17/065
2017/0299244 A1* 10/2017 Alshourbagy ..... F25C 5/06
2017/0307270 A1* 10/2017 Kim ..... F25C 5/22
2019/0011166 A1* 1/2019 Bertolini ..... F25C 5/22
2019/0093938 A1* 3/2019 Miller ..... F25C 5/182
2019/0128584 A1 5/2019 Chandrashekaran et al.
2019/0234667 A1* 8/2019 Lee ..... F25C 5/22

FOREIGN PATENT DOCUMENTS

JP H-0583675 U * 11/1993
JP H 0583675 U * 11/1993
JP 8-94223 4/1996
JP 8-254377 10/1996
JP 10-73352 A 3/1998
JP 2003-106722 4/2003
JP 2003106722 A * 4/2003
JP 2011-64372 3/2011
KR 19990043089 A * 6/1999
KR 100766062 B1 * 10/2007
KR 10-2008-0014598 A 2/2008
KR 20080014598 A * 2/2008
KR 10-1179732 9/2012
KR 10-1584805 1/2016
KR 10-2016-0035532 A 3/2016
KR 101677377 B1 * 11/2016
KR 20160148334 A * 12/2016
KR 10-2017-0123513 11/2017
KR 10-2018-0065446 6/2018
KR 10-1940510 1/2019
KR 10-1959559 3/2019
KR 10-2019-0038275 A 4/2019

OTHER PUBLICATIONS

KR 20080014598 A, machine translation (Year: 2023).*
International Search Report dated Feb. 22, 2021 from International Application No. PCT/KR2020/014815.
Extended European Search Report dated Aug. 11, 2022 for European Application No. 20888982.4.
Office Action dated Jul. 19, 2023, in European Application No. 20 888 982.4.

* cited by examiner

REFRIGERATOR

CROSS-REFERENCE TO RELATED APPLICATION

This application is based on and claims priority under 35 U.S.C. § 119 to Korean Patent Application No. 10-2019-0148912, filed on Nov. 19, 2019 in the Korean Intellectual Property Office, the disclosure of which is incorporated herein by reference.

BACKGROUND

1. Field

The disclosure relates to a refrigerator, and more specifically, to a refrigerator having an ice maker.

2. Description of the Related Art

A refrigerator is a home appliance that is equipped with a main body having a storage compartment, a cold air supply device provided to supply cold air to the storage compartment, and a door provided to open and close the storage compartment and stores food in a fresh state.

The refrigerator may have an ice-making compartment to generate and store ice. In the case of a Bottom Mounted Freezer (BMF) type refrigerator, the ice-making compartment may be provided at a corner inside a refrigerating compartment or may be provided at the rear surface of a refrigerating compartment door.

In the ice-making compartment, an ice maker for generating ice and an ice bucket for storing the ice generated by the ice maker and transporting the ice to a dispenser may be disposed. When the ice-making chamber is provided inside the refrigerating compartment or on the rear surface of the refrigerating compartment door, there is a need to open the door to access the ice maker and ice bucket disposed in the ice-making chamber.

The ice maker may be divided into an indirect cooling type ice-making device that generates ice using cold air that circulates in the ice-making compartment, and a direct cooling type ice-making device that generates ice using a refrigerant pipe of a refrigeration cycle.

SUMMARY

Therefore, it is an object of the disclosure to provide a refrigerator that facilities an access to an ice-making compartment.

It is another object of the disclosure to provide a refrigerator capable of reducing energy consumption.

It is another object of the disclosure to provide a refrigerator capable of generating ice at a higher speed.

Additional aspects of the disclosure will be set forth in part in the description which follows and, in part, will be obvious from the description, or may be learned by practice of the disclosure.

According to an aspect of the disclosure, there is provided a refrigerator including: a main body having a refrigerating compartment and a freezing compartment; a refrigerating compartment door rotatably coupled to the main body to open and to close at least a part of the refrigerating compartment; an ice-making compartment formed on a front surface of the refrigerating compartment door, so that the ice-making compartment is accessible while the refrigerating compartment door is closed; an ice maker disposed in the ice making compartment and including an ice-making tray that is rotatable, and a cold air guide that is deformable and restorable and fixed to the ice-making tray; a dispenser on the refrigerating compartment door to dispense ice from the ice maker; an auxiliary door disposed in front of the refrigerating compartment door and configured to open and to close the ice-making compartment, and having an opening corresponding to the dispenser so that dispenser is accessible through the opening while the auxiliary door is closed; and a cold air duct to connect the ice-making compartment to the freezing compartment so that air from the freezing compartment having a lower temperature than air from the refrigerating compartment flows to the ice-making compartment to cool the ice-making compartment.

The cold air guide may guide the air from the freezing compartment along a rotation axis direction of the ice-making tray.

The cold air guide may be configured to form a cold air flow path between the cold air guide and a bottom surface of the ice-making tray.

The ice maker may include an ice-making case and a driving device disposed at one end of the ice-making case and configured to rotate the ice-making tray to an ice separation position and an ice generation position, wherein the ice-making case may include an inlet cover formed at an end opposite to the one end portion at which the driving device is disposed.

The inlet cover may be configured to guide the air flowing from the freezing compartment from the cold air duct to the cold air flow path.

The inlet cover may be disposed to face an inlet of the cold air flow path.

The refrigerator may further include a connector located in the ice-making compartment and connecting the cold air duct to the inlet cover, and a sealing member provided on at least one end portion of the connector.

The cold air guide may be configured to be deformed by the ice-making case when the ice-making tray is rotated to the ice separation position, and configured to be restored when the ice-making tray is rotated to the ice generation position.

The ice maker may include a temperature sensor device disposed at an end of the ice-making tray that is opposite to one end at which an inlet of the cold air flow path is disposed.

The temperature sensor device may include a temperature sensor and a heat insulating cover provided to cover the temperature sensor.

The ice-making tray may be provided so that an ice-making cell positioned in an area at which the temperature sensor is mounted has a height smaller than a height of another ice-making cell.

When the temperature sensor is mounted on the ice-making stray, a bottom surface of the temperature sensor may be parallel to a bottom surface of the another ice-making cell.

The cold air guide may include a shape retaining portion extending vertically from a rotation axis of the ice-making tray.

The cold air guide may include a guide coupling portion configured to be coupled to the ice-making tray, the ice-making tray may include a tray coupling portion configured to be coupled to the guide coupling portion, and when the cold air guide is coupled to the ice-making tray, the guide coupling portion and the tray coupling portion may be located at a farther distance away from a rotation axis of the ice-making tray than the ice-making cell of the ice-making tray.

The tray coupling portion may include a tray coupling hole into which the guide coupling portion is inserted and fixed.

According to another aspect of the disclosure, there is provided a refrigerator including: a main body having a refrigerating compartment and a freezing compartment; a refrigerating compartment door rotatably coupled to the main body to open and to close at least a part of the refrigerating compartment; an ice-making compartment formed on a front surface of the refrigerating compartment door so that the ice-making compartment is accessible while the refrigerating compartment door is closed an ice maker, disposed in the ice-making compartment, to make ice and including an ice-making case, an ice-making tray that is rotatable coupled to the ice-making case and rotatable to an ice separation position and an ice generation position, and a cold air guide coupled to the ice-making tray and configured to be deformed by the ice-making case when the ice-making tray is rotated to the ice separation position and configured to be restored when the ice-making tray is rotated to the ice generation position, and configured to guide air from the freezing compartment having a lower temperature than air from the refrigerating compartment to the ice making tray.

The cold air guide may be disposed below the ice-making tray.

A portion at which the cold air guide and the ice-making tray are coupled to each other may be arranged to be deviate from a path along which ice is discharged when the ice-making tray separates ice.

The cold air guide may include a shape retaining portion protruding toward the ice-making tray.

The ice-making compartment may be formed with a cold air supply hole through which the air from the freezing compartment is supplied, the ice maker may include a temperature sensor device coupled to an ice-making cell located at an end portion of the ice-making tray that is distant from the cold air supply hole, and the temperature sensor device may have a bottom surface provided to be parallel to a bottom surface of another ice-making cell of the ice-making tray.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure.

Hereinafter, embodiments of the disclosure will be described in detail with reference to the accompanying drawings.

Figure 1:
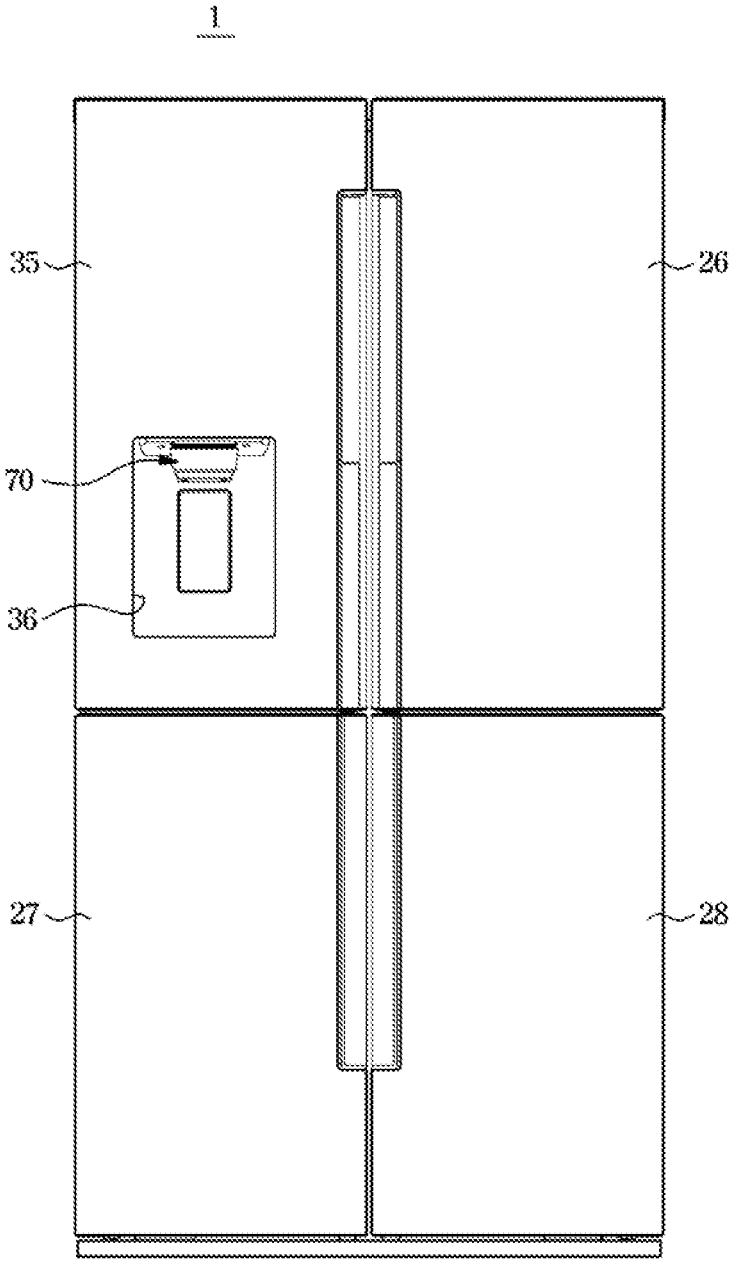
FIG. 1 is a view illustrating a front side of a refrigerator according to an embodiment of the disclosure.
Figure 2:
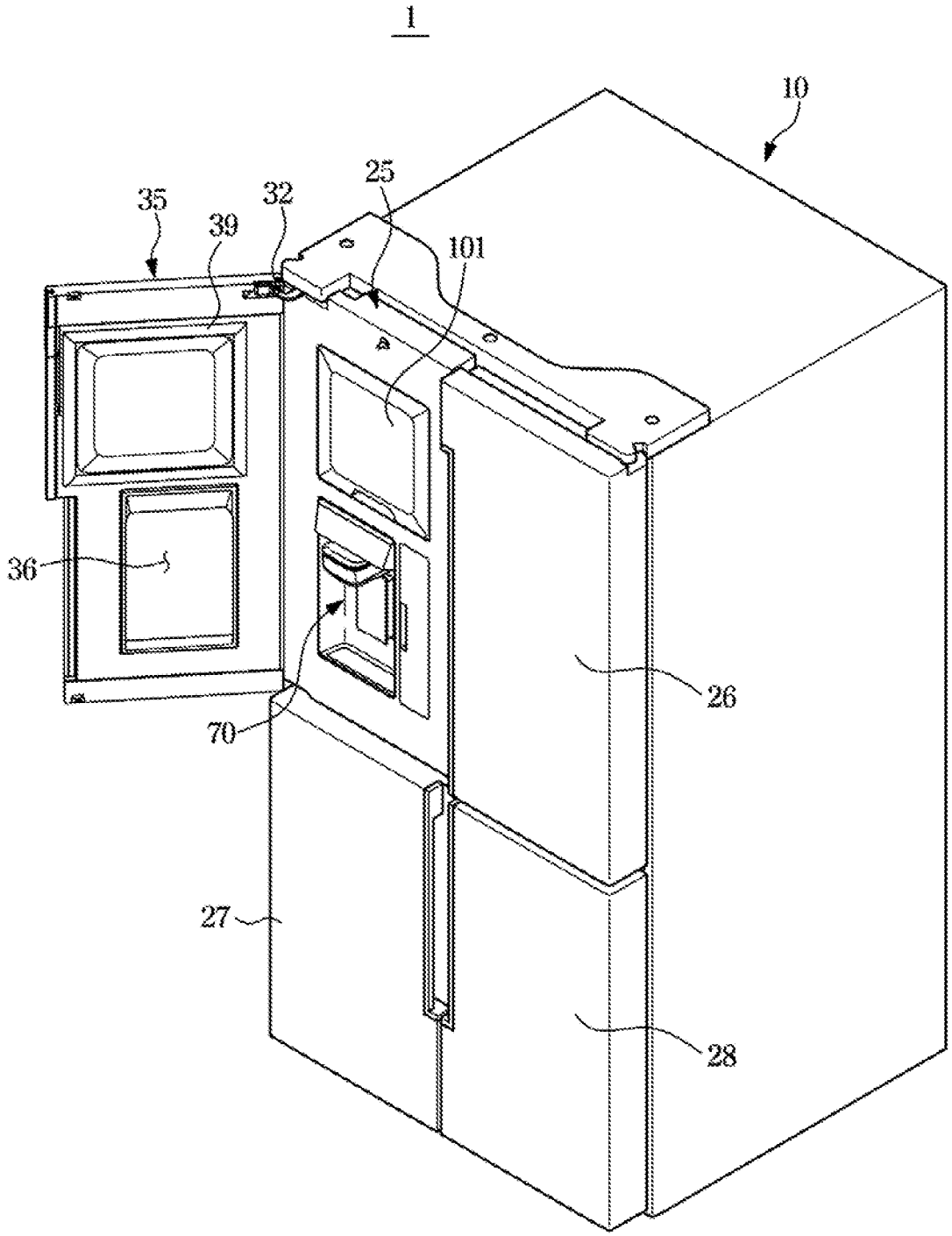
FIG. 2 is a perspective view illustrating a state in which an auxiliary door of the refrigerator shown in FIG. 1 is opened.
Figure 3:
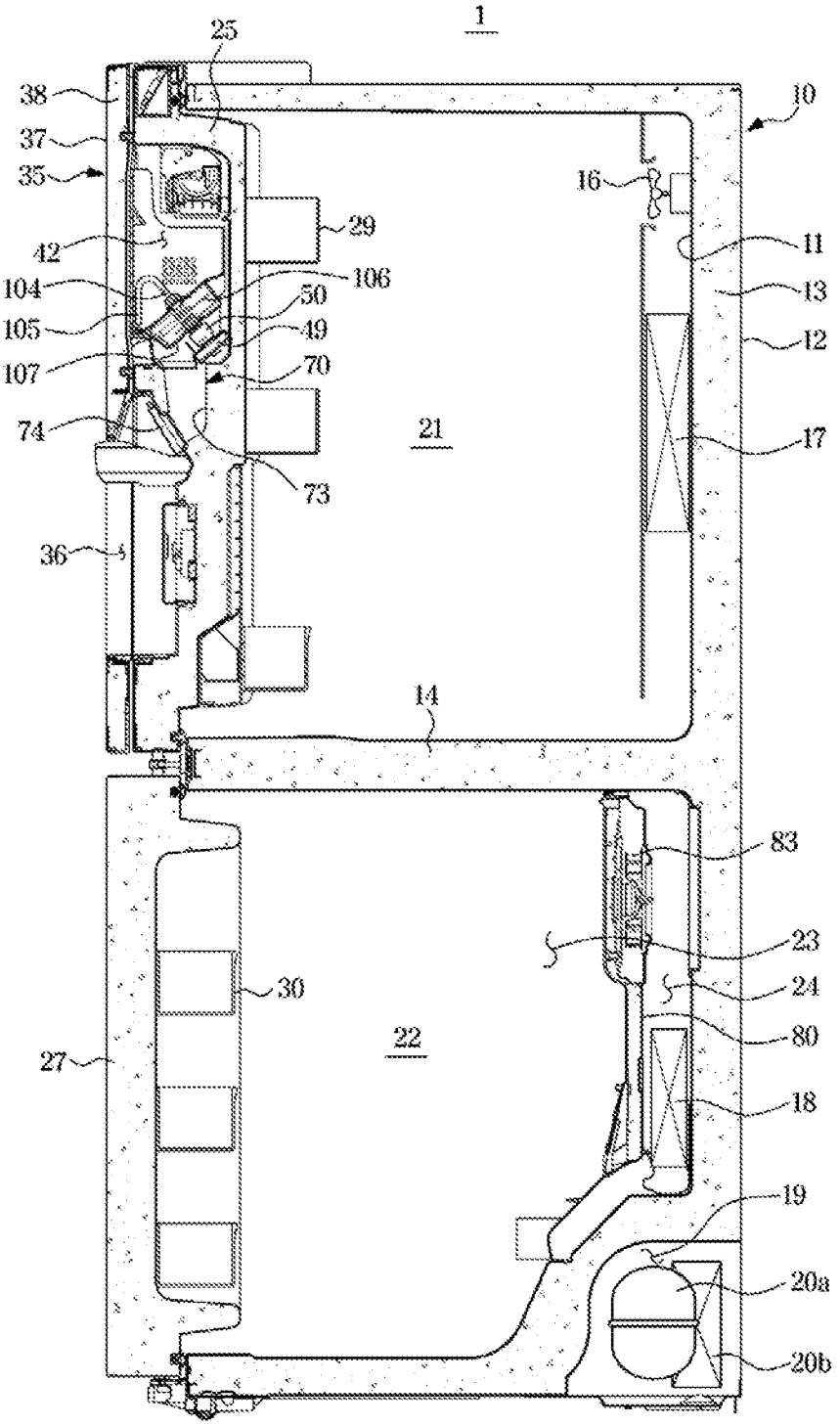
FIG. 3 is a side cross-sectional view schematically illustrating main parts of the refrigerator shown in FIG. 1.
Figure 4:
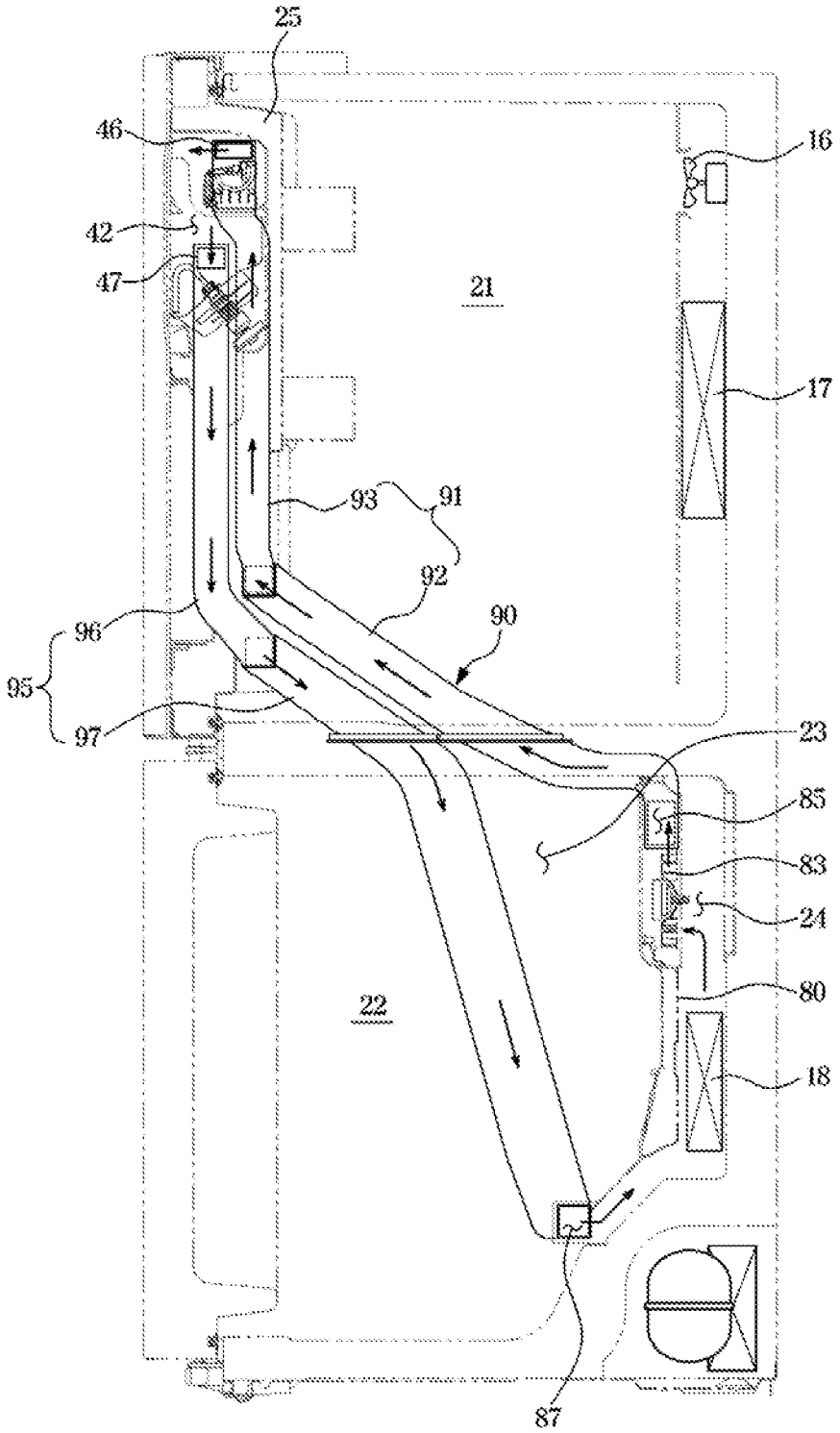
FIG. 4 is a view illustrating a structure in which a freezing compartment is connected to an ice-making compartment through a cold air duct of the refrigerator shown in FIG. 1.
Figure 5:
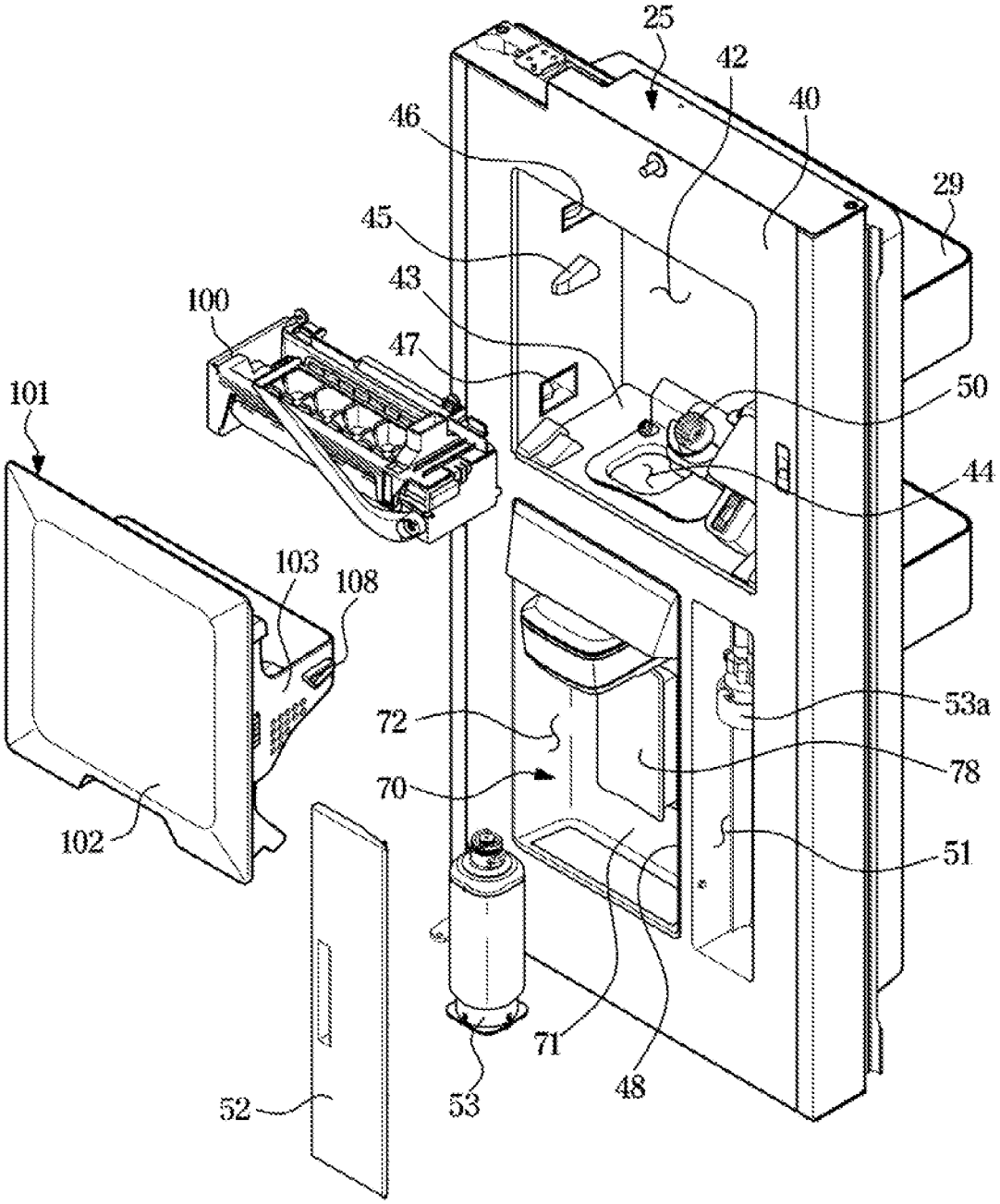
FIG. 5 is an exploded view of the refrigerator in FIG. 2, which shows a state in which some components of a refrigerating compartment door are disassembled.

FIG. 1 is a view illustrating a front side of a refrigerator according to an embodiment of the disclosure. FIG. 2 is a perspective view illustrating a state in which an auxiliary door of the refrigerator shown in FIG. 1 is opened. FIG. 3 is a side cross-sectional view schematically illustrating main parts of the refrigerator shown in FIG. 1. FIG. 4 is a view illustrating a structure in which a freezing compartment is connected to an ice-making compartment through a cold air duct of the refrigerator shown in FIG. 1. FIG. 5 is an exploded view of the refrigerator shown in FIG. 2, which shows a state in which some components of a refrigerating compartment door are disassembled.

Referring to FIGS. 1 to 5, a refrigerator 1 includes a main body 10, a refrigerating compartment 21 and a freezing compartment 22 formed in the main body 10, refrigerating compartment doors 25 and 26 rotatably provided on the main body 10 to open and close the refrigerating compartment 21, freezing compartment doors 27 and 28 rotatably provided on the main body 10 to open and close the freezing compartment 22, an ice-making compartment 42 formed on the refrigerating compartment door 25, and a cold air supply device provided to supply cold air to the refrigerating compartment 21, the freezing compartment 22, and the ice-making compartment 42.

The refrigerating compartment 21 and the freezing compartment 22 are divided by an intermediate wall 14, and the refrigerating compartment 21 may be formed at an upper side of the main body 10, and the freezing compartment 22 may be formed at a lower side of the main body 10. The refrigerating compartment 21 may be maintained at a temperature of about 0° C. to 5° C. so that food is stored refrigerated. The freezing compartment 22 is maintained at a temperature of about −30° C. to 0 degrees so that food is stored frozen. The ice-making compartment 42 may be divided from the refrigerating compartment 21 and communicate with the freezing compartment 22 through a cold air duct 90. The ice-making compartment 42 may be maintained at the same temperature as that of the freezing compartment 22 to generate and store ice.

The cold air supply device may include a compressor 20*a*, a condenser 20*b*, evaporators 17 and 18, and an expansion device (not shown), and may generate cold air using latent heat of evaporation of a refrigerant. The compressor 20*a* and the condenser 20*b* may be disposed in a machine room 19 formed at a rear lower portion of the main body 10.

The evaporators 17 and 18 may include a refrigerating compartment evaporator 17 disposed in the refrigerating compartment 21 and a freezing compartment evaporator 18 disposed in the freezing compartment 22. Cold air generated by the refrigerating compartment evaporator 17 may be supplied to the refrigerating compartment 21 by an operation of a refrigerating compartment blower fan 16. Cold air generated by the freezing compartment evaporator 18 may be supplied to the freezing compartment 22 and the ice-making compartment 42 by an operation of a freezing compartment blower fan 83.

The refrigerator 1 may include a cold air duct 90 configured to guide cold air generated by the evaporator 18 to the ice-making compartment 42.

The main body 10 includes an inner case 11 forming the refrigerating compartment 21 and the freezing compartment 22, an outer case 12 coupled to an outer side of the inner case 11 and forming the external appearance of the refrigerator 1, and a heat insulator 13 provided between the inner case 11 and the outer case 12. The inner case 11 may be formed of a plastic material, and the outer case 12 may be formed of a metal material. As the insulator 13, a urethane foam insulator or a vacuum insulation panel may be used.

The refrigerating compartment 21 is provided with a front side thereof open so that food may be put in and out, and the open front side may be opened and closed by the refrigerating compartment doors 25 and 26. The refrigerating compartment doors 25 and 26 include a refrigerating compartment door 25 provided on the left side and a refrigerating compartment door 26 provided on the right side, and each of the refrigerating compartment doors 25 and 26 may open and close at least a part of the refrigerating compartment 21. The refrigerating compartment doors 25 and 26 may be coupled to the main body 10 so as to be rotatable in a leftward/rightward direction. Door guards 29 may be provided on rear surfaces of the refrigerator compartment doors 25 and 26 to store food.

The freezing compartment 22 may be provided with a front side thereof open so that food may be put in and out, and the opened front side may be opened and closed by the freezing compartment doors 27 and 28. Door guards 30 may be provided at rear surfaces of the freezing compartment doors 27 and 28 to store food.

On the refrigerating compartment door 25, the ice-making chamber 42 and a dispenser 70 may be provided. The ice-making compartment 42 may be provided at an upper portion of the refrigerating compartment door 25, and the dispenser 70 may be provided at a lower portion of the refrigerating compartment door 25.

The ice-making chamber 42 may be formed on the front surface of the refrigerating compartment door 25 so as to be accessible while the refrigerating compartment door 25 is closed. Therefore, to access the ice-making compartment 42, the user does not need to open the refrigerating compartment door 25, and an operation of withdrawing ice or repairing and replacing the ice maker and ice bucket may be facilitated. In addition, since the refrigerating compartment 21 is allowed to remain closed by the refrigerating compartment door 25 in access to the ice-making chamber 42, leakage of cold air in the refrigerating compartment 21 may be prevented, and energy may be saved.

The freezing compartment 22 may be divided into a storage space 23 for storing food and a heat exchange space 24 in which the freezing compartment evaporator 18 is disposed to generate cold air. In order to divide the freezing compartment 22 into the storage space 23 and the heat exchange space 24, an evaporator duct 80 may be disposed in the freezing compartment 22.

In order to control whether to supply the cold air generated in the heat exchange space 24 to the ice-making compartment 42, a damper device (not shown) may be provided in the evaporator duct 80. According to the operation of the damper device, all of the cold air generated in the heat exchange space 24 may be supplied to the storage space 23. Alternatively, a part of the cold air generated in the heat exchange space 24 may be supplied to the storage space 23 and a remaining part may be supplied to the ice-making compartment 42.

The cold air duct 90 may connect the heat exchange space 24 to the ice-making compartment 42. The cold air duct 90 may include a supply duct 91 for supplying cold air of the heat exchange space 24 to the ice-making compartment 42 and a recovery duct 95 for recovering the cold air of the ice-making compartment 42 to the heat exchange space 24.

The supply duct 91 may include a main body supply duct 92 provided in the main body 10 and a door supply duct 93 provided in the refrigerating compartment door 25. When the refrigerating compartment door 25 is closed, the main body supply duct 92 and the door supply duct 93 are connected to each other, and when the refrigerating compartment door 25 is opened, the main body supply duct 92 and the door supply duct 93 may be separated from each other.

The recovery duct 95 may include a door recovery duct 96 provided in the refrigerating compartment door 25 and a main body recovery duct 97 provided in the main body 10. When the refrigerating compartment door 25 is closed, the door recovery duct 96 and the main body recovery duct 97 are connected to each other, and when the refrigerating compartment door 25 is opened, the door recovery duct 96 and the main body recovery duct 97 may be separated from each other.

The main body supply duct 92 and the main body recovery duct 97 may be installed between the inner case 11 and the outer case 12 of the main body 10. The main body supply duct 92 and the main body recovery duct 97 may be attached to an outer surface of the inner case 11.

The cold air duct 90 may be connected to the evaporator duct 80. Specifically, the evaporator duct 80 may include a cold air outlet 85 and a cold air inlet 87.

The cold air outlet 85 may be connected to the supply duct 91. The cold air of the heat exchange space 24 may be supplied to the ice-making compartment 42 through the cold air outlet 85 and the supply duct 91. The cold air inlet 87 may be connected to the recovery duct 95. The cold air of the ice-making compartment 42 may be recovered to the heat exchange space 24 through the recovery duct 95 and the cold air inlet 87.

The refrigerator 1 may further include an auxiliary door 35 provided on the front of the refrigerating compartment door 25 to open and close the ice-making compartment 42. The auxiliary door 35 may be coupled to the refrigerating compartment door 25 through an auxiliary hinge 32 so to be rotatable in the leftward/rightward direction.

The auxiliary door 35 may be provided at a rear surface thereof with a gasket 39 configured to be in close contact with the front of the refrigerating compartment door 25 to seal the ice-making compartment 42 when the auxiliary door 35 is closed.

The auxiliary door 35 may have a size corresponding to that of the refrigerating compartment door 25. The auxiliary door 35 may have an opening 36 allowing the dispenser 70 of the refrigerator compartment door 25 to be exposed when the auxiliary door 35 is in a closed state. The opening 36 may be formed at a position corresponding to the dispenser 70 and have a size corresponding to the dispenser 70. Accordingly, even when the auxiliary door 35 is in a closed state, the dispenser 70 may be accessed through the opening 36.

In the ice-making compartment 42, an ice maker 100 to generate ice and an ice bucket 101 to store ice may be disposed. A support rib 45 may be formed on a door front plate 40 of the refrigerating compartment door 25 to support a locking rib 108 of the ice bucket 101.

The ice bucket 101 may include an ice bucket cover 102 formed to cover the open front surface of the ice-making compartment 42 and a bucket body 103 forming a space for storing ice. The ice bucket 101 may be provided with a stirrer 105 that is rotatably provided to stir and transport ice stored in the bucket body 103. A crushing blade 106 configured to crush ice may be coupled to a central axis 104 of the stirrer 105. The bucket body 103 may be provided at a lower portion with an ice discharge port 107 through which ice may be discharged to the outside of the ice bucket 101.

In the ice-making compartment 42, a transport motor 49 configured to rotate the stirrer 105 and the crushing blade 106 may be disposed. A driving coupler 50 may be coupled to the transport motor 49. When the ice bucket 101 is mounted in the ice-making compartment 42, the central axis 104 of the stirrer 105 is connected to the driving coupler 50, and when the ice bucket 101 is separated from the ice-making compartment 42, the central axis 104 of the stirrer 105 may be separated from the driving coupler 50.

The door front plate 40 may include an ice-making chamber bottom 43 that forms a lower surface of the ice-making chamber 42. The ice-making chamber bottom 43 may be formed with an ice pathway hole 44 configured to communicate the ice-making chamber 42 with the dispenser 70. Ice discharged from the ice bucket 101 may be guided to a chute 73 of the dispenser 70 through the ice pathway hole 44.

The door front plate 40 may be formed with a cold air supply hole 46 to which the door supply duct 93 is connected to supply cold air to the ice-making compartment 42, and a cold air recovery hole 47 to which the door recovery duct 96 is connected to recover cold air of the ice-making compartment 42.

The door front plate 40 may be formed with a dispenser installation hole 48 that is open to install the dispenser 70. A dispenser housing 71 of the dispenser 70 may be installed in the dispenser installation hole 48.

On the door front plate 40, a water filter accommodating portion 51 in which a water filter 53 for purifying water is accommodated may be formed. The water filter accommodating portion 51 may be formed by a portion of the door front plate 40 being recessed backward. A filter cap 53*a* may be provided in the water filter accommodating portion 51, and the water filter 53 may be coupled to the filter cap 53*a*. The water filter 53 may purify water supplied from an external water supply source through a water supply line (not shown) and supply the purified water to a water tank (not shown) or the ice maker 100. A filter cover 52 may be coupled to the water filter accommodating portion 51 to cover the open front surface of the water filter accommodating portion 51.

Since the water filter 53 is mounted on the front surface of the refrigerating compartment door 25 as described above, the water filter 53 may be easily replaced and repaired without opening the refrigerating compartment door 25.

The dispenser 70 may provide water or ice. The dispenser 70 may be installed on the refrigerating compartment door 25.

The dispenser 70 may include a dispenser housing 71 formed to be recessed to form a dispensation space 72, the chute 73 that is a passage for guiding ice of the ice-making compartment 42 to the dispensation space 72, and a lever 78 that is manipulated by the user to operate the dispenser 70.

The dispenser 70 may further include a chute opening/closing device 74 provided to open and close the chute 73. The chute opening/closing device 74 may open or close the chute 73 so that ice is allowed to pass through the chute 73 or prevented from passing through the chute 73. When the chute opening/closing device 74 opens the chute 73, ice of the ice-making compartment 42 may be provided through the dispenser 70. When the chute opening/closing device 74 closes the chute 73, the chute opening/closing device 74 may seal the chute 73 so that cold of the ice-making compartment 42 does not flow through the chute 73.

The auxiliary door 35 may include an auxiliary door case 37 and an auxiliary door insulator 38 provided inside the auxiliary door case 37 to insulate the ice-making compartment 42. The auxiliary door insulator 38 may be a urethane foam insulation or a vacuum insulation panel, similar to the insulator 13 of the main body 10 and the insulator 54 of the refrigerating compartment door 25.

Figure 6:
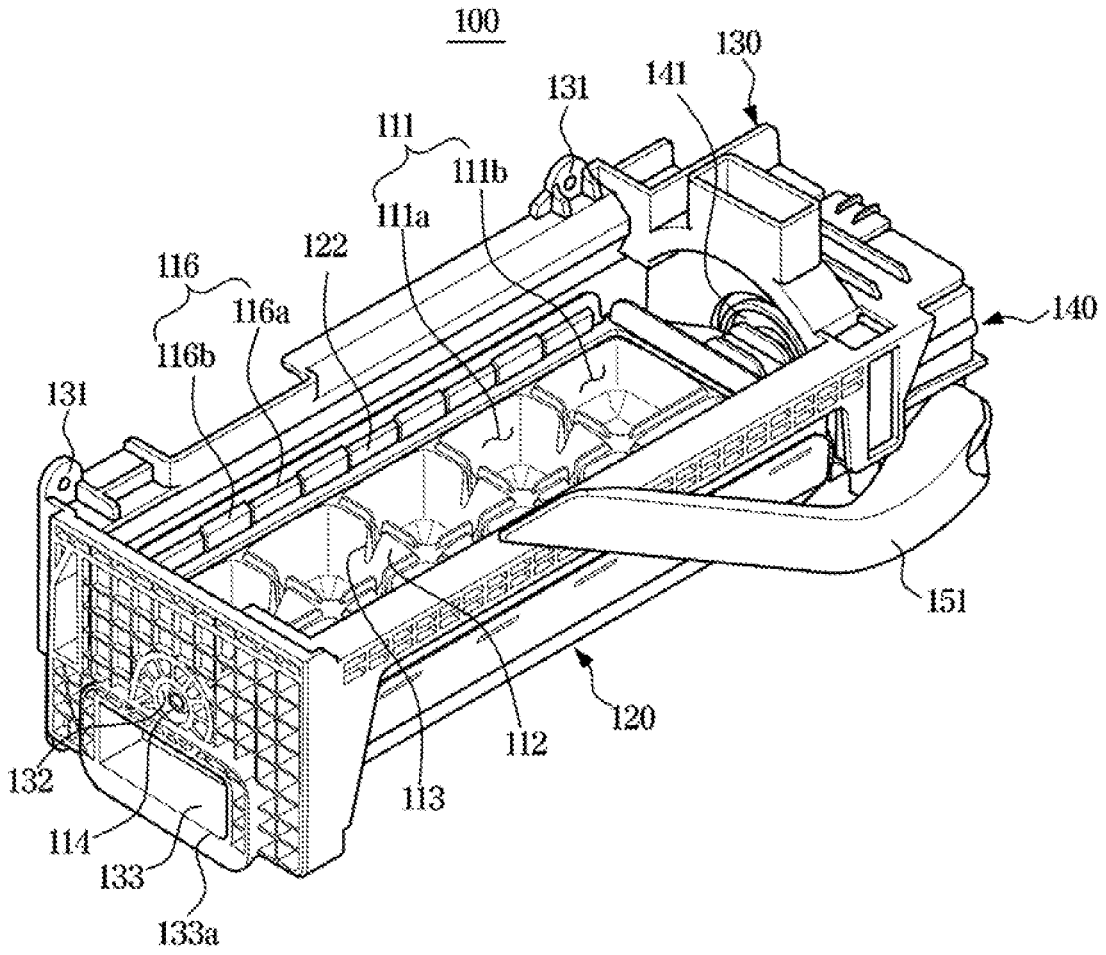
FIG. 6 is a view illustrating an ice maker shown in FIG. 5.
Figure 7:
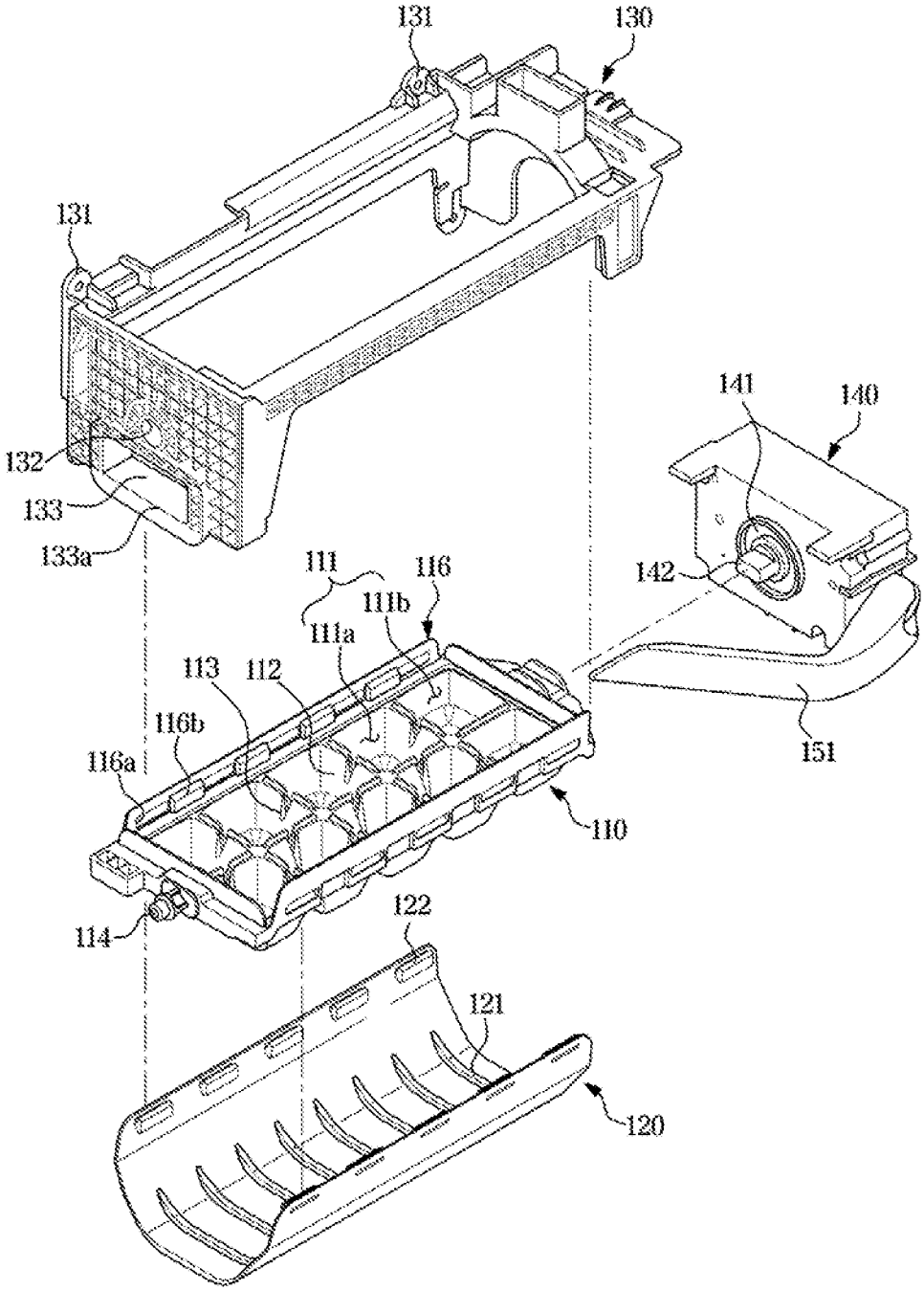
FIG. 7 is an exploded view of the ice maker shown in FIG. 6.
Figure 8:
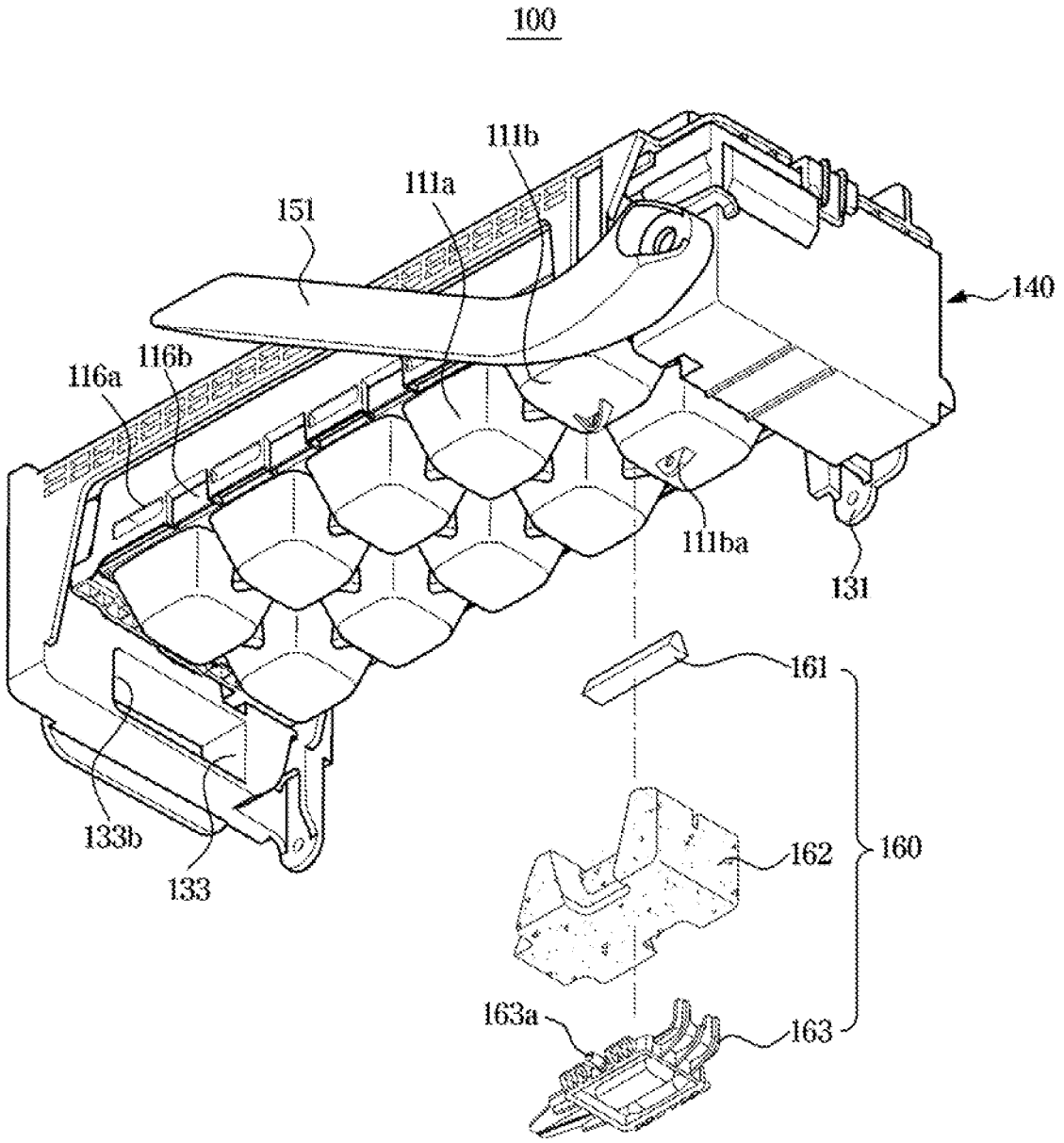
FIG. 8 is an exploded view illustrating a temperature sensor device of the ice maker shown in FIG. 6.

FIG. 6 is a view illustrating an ice maker shown in FIG. 5. FIG. 7 is an exploded view of the ice maker shown in FIG. 6. FIG. 8 is an exploded view illustrating a temperature sensor device of the ice maker shown in FIG. 6.

Referring to FIGS. 6 and 7, the ice maker 100 includes an ice-making tray 110, a cold air guide 120 disposed below the ice-making tray 110, and an ice-making case 110 rotatably supporting the ice-making tray 110, and a driving device 140 configured to rotate the ice-making tray 110.

The ice-making tray 110 may include a plurality of ice-making cells 111 configured to store water, a cell divider 112 configured to divide the plurality of ice-making cells 111 from each other, and a passage groove 113 formed in the cell divider 112 to allow water to flow through the cell divider 112. The ice-making tray 110 may include a material that may be deformed by the rotational force of the driving motor 141 so that ice is discharged in a twist mechanism.

The ice-making tray 110 may include a rotation axis portion 114. The rotation axis portion 114 may be located at one side of the ice-making tray 110. The rotation axis portion 114 may be coupled to a rotation axis coupling portion 132 of the ice-making case 130. The ice-making tray 110 may be rotatably supported by the ice-making case 130 by the rotation axis portion 114. The rotation axis portion 114 may extend along the rotation axis direction of the ice-making tray 110.

Figure 9:
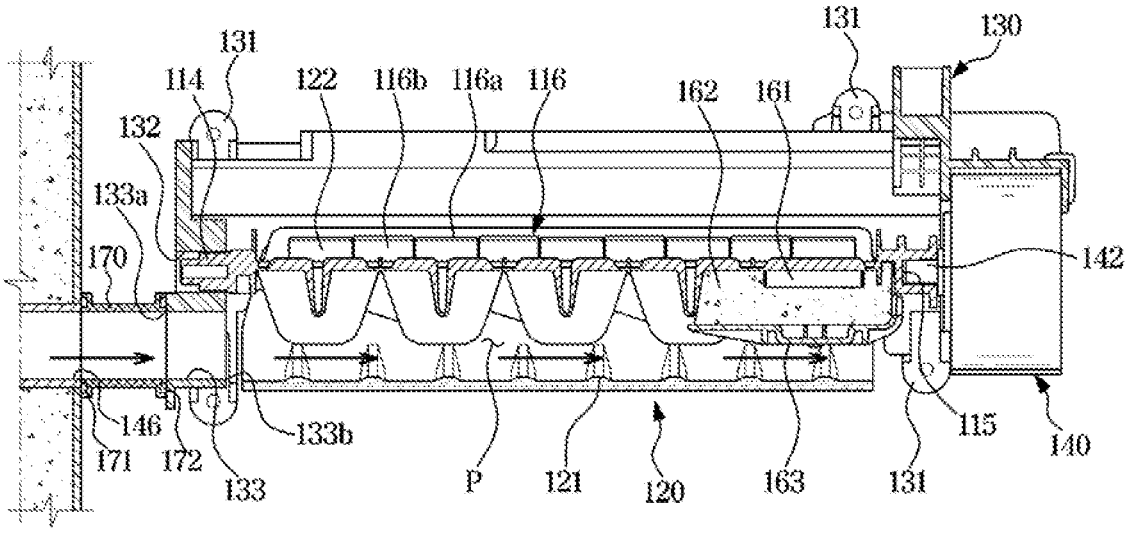
FIG. 9 is a cross-sectional view illustrating a flow of cold air supplied to the ice maker shown in FIG. 6.

The ice-making tray 110 may include a driving shaft coupling portion (115 in FIG. 9). The driving shaft coupling portion 115 may be coupled to a driving shaft 142 of the driving device 140. The driving shaft coupling portion 115 may be located at a side of the ice-making tray 110 opposite to the one side at which the rotation axis portion 114 is located. The ice-making tray 110 may be rotated by receiving power from the driving motor 141 by the driving shaft coupling portion 115. The driving shaft coupling portion 115 may have a shape corresponding to the driving shaft 142. The driving shaft coupling portion 115 may have a shape capable of receiving rotational force from the driving shaft 142.

The ice-making tray 110 may include a tray coupling portion 116 to which the cold air guide 120 is fixed. The 116 may include a tray coupling hole 116*a* and a tray coupling protrusion 116*b*. The tray coupling hole 116*a* and the tray coupling protrusion 116*b* may be alternately arranged. The tray coupling protrusion 116*b* may be arranged between the tray coupling holes 116*a*, and the tray coupling hole 116*a* may be arranged between the tray coupling protrusions 116*b*.

The tray coupling hole 116*a* allows a guide coupling portion 122 of the cold air guide 120 to be insertedly fixed thereto. The tray coupling hole 116*a* may be provided so that the guide coupling portion 122 is coupled thereto in a snap fit method. Alternatively, the tray coupling hole 116*a* may be provided so that the guide coupling portion 122 is coupled thereto in a force fitting manner.

When the cold air guide 120 is coupled to the ice-making tray 110, the tray coupling protrusion 115*b* may restrict movement of the cold air guide 120 along the rotation axis direction of the ice-making tray 110. The tray coupling protrusion 116*b* may be located outward of the ice-making tray 110 relative to the ice-making cell 111. The tray coupling protrusion 116*b* may be located at a farther distance away from the rotation axis of the ice-making tray 110 than the ice-making cell 111 is. The tray coupling protrusion 116*b* may be arranged at a side away from a path in which ice is discharged when the ice-making tray 110 rotates to separate ice. Accordingly, when ice is separated from the ice-making cell 111 and discharged to the ice bucket 101, the tray coupling protrusion 116*b* may not interfere with the ice.

The cold air guide 120 may be fixed to the ice-making tray 110. The cold air guide 120 may be provided to guide cold air along a direction in which the rotation axis of the ice-making tray 110 extends. Accordingly, the cold air guide 120 may be provided to form a cold air flow path P between the ice-making tray 110 and the cold air guide 120. The cold air guide 120 may be disposed below the ice-making tray 110. Since cold air is supplied to an area below the ice-making tray 110 by the cold air guide 120, the ice quality of ice generated in the ice-making tray 110 may be improved. That is, compared to a case when cold air is supplied from an area above the ice-making tray 110, the ice maker 100 according to the embodiment of the disclosure may have improve the ice quality.

The cold air guide 120 may be deformed by the ice-making case 130 when the ice-making tray 110 rotates for ice-separation. The cold air guide 120 may be restored to the original shape when the ice-making tray 110 rotates to a position for ice-making after completing ice-separation. To this end, the cold air guide 120 may include a deformable material. The cold air guide 120 may include a material having a restoring force. The cold air guide 120 may include a flexible material. With such a configuration, the ice maker 100 may provide the cold air guide 120 while occupying a relatively small space, so that the ice-making speed may be improved.

That is, since the ice maker 100 of the refrigerator 1 according to the embodiment of the disclosure is provided to allow the cold air guide 120 to be deformable, the ice-making case 130 does not need to be excessively large to ensure a space for rotation of the cold air guide 120.

The cold air guide 120 may include a shape retaining portion 121 extending in a direction perpendicular to a direction in which the rotation axis portion 114 of the ice-making tray 110 extends. The shape retaining portion 121 may be provided in plural while being spaced apart from each other by a predetermined interval along the direction in which the rotation axis portion 114 of the ice-making tray 110 extends. The shape retaining portion 121 may protrude toward the ice-making tray 110. When the ice-making tray 110 returns from the position for ice-separation to the position for ice-making, the shape retaining portion 121 may allow the cold air guide 120 to return to the original shape and maintain the shape.

The cold air guide 120 may include the guide coupling portion 122 by which the cold air guide 120 is coupled to the ice-making tray 110. The guide coupling portion 122 may be coupled to the tray coupling hole 116*a* in a snap fit manner. Alternatively, the guide coupling portion 122 may be coupled to the tray coupling hole 116*a* in a force fitting manner. When the guide coupling portion 122 is coupled to the tray coupling hole 116*a*, the guide coupling portion 122 may be locate outward of the ice-making tray 110 relative to the ice-making cell 111. The guide coupling portion 122 may be located at a farther distance away from the rotation axis of the ice-making tray 110 than the ice-making cell 111 is. The guide coupling portion 122 may be arranged at a side away from a path in which ice is discharged when the ice-making tray 110 rotates and ice is separated. Accordingly, when ice is separated from the ice-making cell 111 and discharged to the ice bucket 101, the guide coupling portion 122 may not interfere with the ice.

In addition, in the ice maker 100 according to the embodiment of the disclosure, the guide coupling portion 122 is coupled to the tray coupling hole 116*a* in a direction toward the inside of the ice-making tray 110, so that the ice maker 100 is prevented from having an excessive large width, and ensures compact structure.

The ice-making case 130 may be mounted in the ice-making compartment 42 formed on the door front plate 40. The ice-making case 130 may include an ice maker installation portion 131 that allows the ice-making case 130 to be fixed to the ice-making compartment 42 through a fastening member (not shown). The ice maker installation portion 131 may be located at one side of the ice-making case 130 facing the inner surface of the ice-making compartment 42 when the ice maker 100 is installed in the ice-making compartment 42.

The ice-making case 130 may include the rotation axis coupling portion 132 that rotatably supports the ice-making tray 110. The rotation axis coupling portion 132 may be coupled to the rotation axis portion 114 of the ice-making tray 110. The rotation axis coupling portion 132 may be provided to restrain the rotation of the rotation axis portion 114 of the ice-making tray 110 when the ice-making tray 110 rotated for ice-separation is twisted to discharge ice. While the rotation axis coupling portion 132 is restraining the rotation of the rotation axis portion 114, the tray driving motor 141 rotates the driving shaft coupling portion 115 of the ice making tray 110 by a predetermined angle so that the ice-making tray 110 is twisted to discharged ice.

The ice-making case 130 may include an inlet cover 133 formed at an end portion that is opposite to one end portion at which the tray driving device 140 is disposed. The inlet cover 133 may include a cover entrance 133*a* and a cover exit 133*b*. The cover entrance 133*a* of the inlet cover 133 may be provided to face the cold air supply hole 46. The cover exit 133*b* of the inlet cover 133 may be disposed to face an inlet of the cold air flow path P. As the inlet cover 133 guides cold air supplied to the ice-making compartment 42 through the cold air duct 90 to be directed to the cold air flow path P, the refrigerator 1 according to the embodiment of the disclosure may minimize the loss of cold air.

The driving device 140 may be disposed at one end portion of the ice-making case 130. The driving device 140 may include the driving motor 141 for rotating the ice-making tray 110 forward and backward. Various electronic components and driving components for controlling the operation of the ice maker 100 may be disposed in the driving device 140. The electronic components and driving parts may include a circuit board for controlling the driving motor 141 and a gear for reducing the rotational force of the driving motor 141.

The ice maker 100 may include a detection lever 151 configured to detect whether the ice bucket 101 is full. The detection lever 151 may be installed at one side of the driving device 141. The detection lever 151 may move up and down to detect whether the ice bucket 101 is full. When the detection lever 151, once having been rotated downward, detects no ice in the ice bucket 101, a controller (not shown) may control the refrigerator 1 to supply water to the ice-making tray 110.

Referring to FIG. 8, the ice maker 100 may include a temperature sensor device 160 for measuring the internal temperature of the ice-making tray 110. The temperature sensor device 160 may be disposed at an end of the ice-making tray 110 opposite to the one end at which the inlet of the cold air flow path P is located. The temperature sensor device 160 may be coupled to a second ice-making cell 111*b* located at an end portion of the ice-making tray 110 distant from the cold air supply hole 46. The temperature sensor device 160 may be mounted on the second ice-making cell 111*b* to which cold air is supplied last among the ice-making cells 111 of the ice-making tray 110. Since the temperature sensor device 160 determines whether ice generation has been completed by measuring the temperature of the second ice-making cell 111*b* to which cold air is supplied last, rather than a first ice-making cell 111*a* to which cold air is supplied first, the temperature sensor device 160 may determine when ice generation of all the ice-making cells 111 of the ice-making tray 110 is completed.

The temperature sensor device 160 may include a temperature sensor 161, a heat insulating cover 162, and a sensor mounting portion 163. The heat insulation cover 162 may be provided to cover the temperature sensor 161. The heat insulating cover 162 may cover the temperature sensor 161 so that the temperature sensor 161 is not exposed to the cold air flow path P. The heat insulating cover 162 may minimize the influence on the temperature sensor 161 by the cold air existing in the cold air flow path P The temperature sensor 161 may be disposed on an upper surface of the heat insulating cover 162 facing the ice-making tray 110. The heat insulating cover 162 on which the temperature sensor 161 is mounted may be mounted on the ice-making tray 110 through the sensor mounting portion 163. The sensor mounting portion 163 may include a sensor coupling member 163*a* configured to be mounted on a sensor coupling portion 111*ba* of the second ice-making cell 111*b*.

FIG. 9 is a cross-sectional view illustrating a flow of cold air supplied to the ice maker shown in FIG. 6.

Referring to FIG. 9, a flow of cold air supplied to the ice maker 100 according to the embodiment of the disclosure will be described.

Referring to FIG. 9, the refrigerator 1 according to the embodiment of the disclosure may further include a connector 170 connecting the cold air supply hole 46 to the inlet cover 133. The connector 170 may connect the cold air duct 90 to the inlet cover 133 of the ice maker 100. The connector 170 may be disposed in the ice-making compartment 42. A first sealing member 171 may be provided at a portion at which the connector 170 is connected to the cold air supply hole 46. A second sealing member 172 may be provided at a portion at which the connector 170 is connected to the inlet cover 133. The refrigerator 1 according to the embodiment of the disclosure may guide cold air to the cooling air flow path P while minimizing the loss of cold air by the connector 170. The connector 170 may be omitted as needed.

The cold air supplied to the ice-making compartment 42 through the cold air supply hole 46 may be guided to the cold air flow path P through the inlet cover 133. The cold air guided to the cold air flow path P flows between the ice-making cell 111 and the cold air guide 120, and takes heat from the water stored in the ice-making cell 111 to generate ice.

The second ice-making cell 111*b* may have a height smaller than that of the first ice-making cell 111*a*. The ice maker 100 is provided such that the bottom surface of the temperature sensor device 160 and the bottom surface of the first ice-making cell 111*a* are substantially parallel to each other when the temperature sensor device 160 is mounted on the second ice-making cell 111*b*. The ice maker 100 may be provided such that the total height of the second ice-making cell 111*b* on which the temperature sensor device 160 is mounted is substantially the same as the height of the first ice-making cell 111*a*. Accordingly, the cold air flowing through the cold air flow path P may receive a minimum flow resistance by the ice-making tray 110.

The cold air having passed through the ice maker 100 may be discharged back to the ice-making compartment 42 and then recovered through the cold air recovery hole 47.

Figure 10:
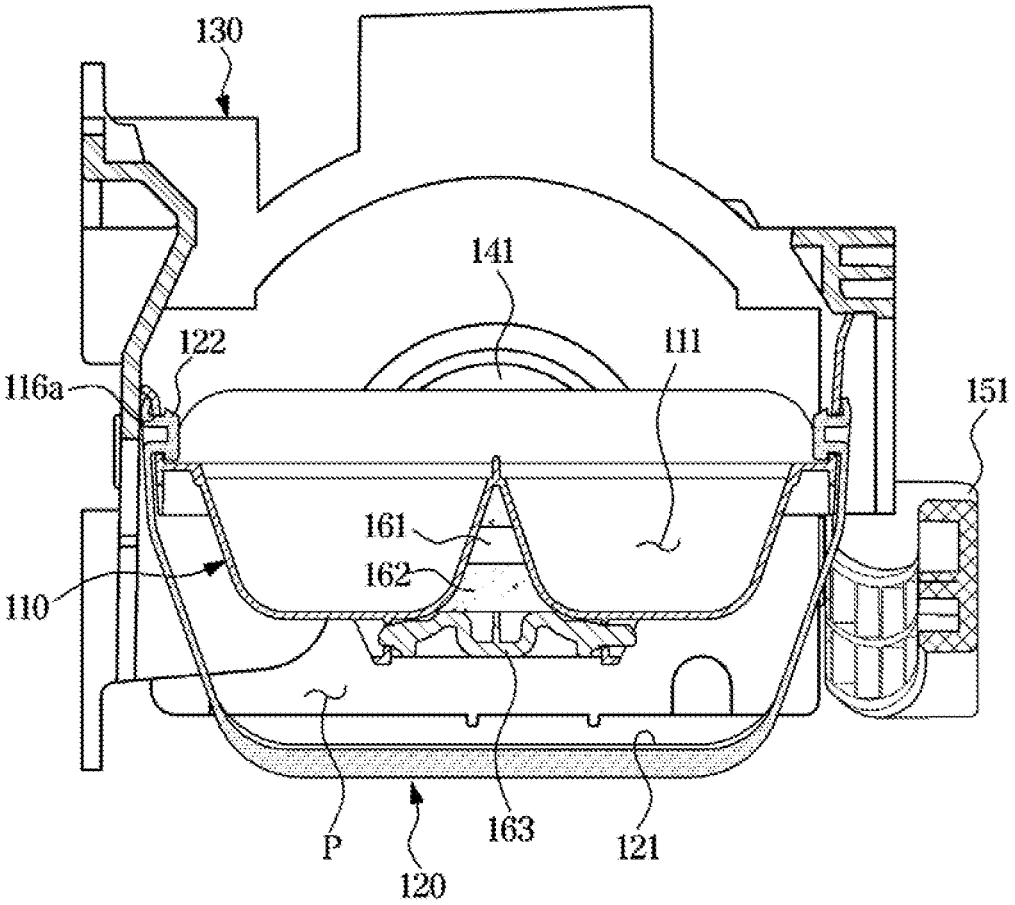
FIG. 10 is a view illustrating a state in which an ice-making tray of the ice maker shown in FIG. 6 is held in an ice-making position.
Figure 11:
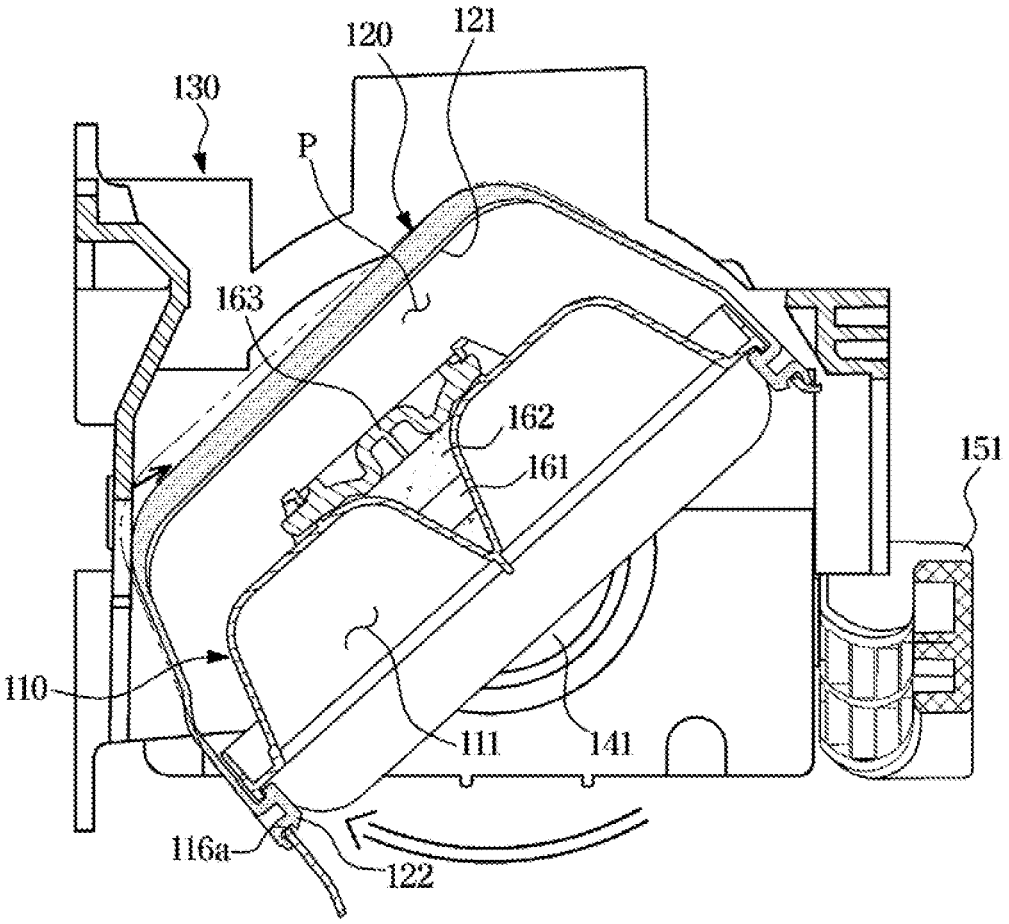
FIG. 11 is a view illustrating a state in which an ice-making tray of the ice maker shown in FIG. 6 is held in an ice separating position.

FIG. 10 is a view illustrating a state in which an ice-making tray of the ice maker shown in FIG. 6 is held in an ice-making position. FIG. 11 is a view illustrating a state in which an ice-making tray of the ice maker shown in FIG. 6 is held in an ice separating position.

The driving of the cold air guide 120 will be described with reference to FIGS. 10 and 11.

Referring to FIG. 10, when the ice-making tray 110 is in a position for ice-making, the cold air guide 120 forms the cold air flow path P together with the ice-making tray 110. The temperature sensor device 160 measures the temperature of the ice-making cell 111 and transmits the measurement result to the controller (not shown), and the controller determines whether ice formation has been completed.

Referring to FIG. 11, when ice formation is completed, the driving motor 141 is operated to rotate the ice-making tray 110 to a position for ice separation. When the ice-making tray 110 rotates for ice-separation, the cold air guide 120 rotates together with the ice-making tray 110. In the process of rotation, the cold air guide 120 is caused to contact the ice-making case 130. The cold air guide 120 including a flexible material is deformed by the ice-making case 130 while continuously rotating together with the ice-making tray 110.

Referring to FIG. 11, when the ice-making tray 110 is in a position for ice separation, the rotation axis portion 114 is restricted from being rotated due to the rotation axis coupling portion 132, and the driving shaft coupling portion 115 is continuously rotated by the driving shaft 142, thereby causing the ice-making tray 110 to be twisted. With such an operation, ice in the ice-making tray 110 may fall into the ice bucket 101.

When the ice separating operation of the ice-making tray 110 is completed, the driving motor 141 rotates the ice-making tray 110 back to the ice-making position as shown in FIG. 10. Accordingly, the cold air guide 120 fixed to the ice-making tray 110 is also rotated to the original position. When the cold air guide 120, as a result of the rotation, is released from the interference with the ice-making case 130, the cold air guide 120 may be restored to the original shape. Accordingly, the cold air guide 120 may form the cold air flow path P between the cold air guide 120 and the ice-making tray 110 again.

With such a configuration, the ice maker 100 according to the disclosure may improve the ice-making speed while occupying a relatively small space.

As is apparent from the above, the refrigerator includes the ice-making chamber that is formed on a front surface of the door so that the ice-making chamber is accessed without a need to open the door, thereby facilitating dispensing of ice and repair and replacement of the ice maker and the ice bucket.

The refrigerator includes the door that is maintained in a closed state when the user accesses the ice-making compartment, thereby preventing cold air of the storage compartment from leaking and reducing energy consumption.

The refrigerator includes the cold air guide that is formed of a flexible material and provided in the ice-making tray, so that the ice-making speed can be improved.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A refrigerator comprising:

a main body having a refrigerating compartment and a freezing compartment;

a refrigerating compartment door rotatably coupled to the main body to open and to close at least a part of the refrigerating compartment;

an ice-making compartment formed on a front surface of the refrigerating compartment door so that the ice-making compartment is accessible while the refrigerating compartment door is closed;

an ice maker disposed in the ice-making compartment and including an ice-making case, an ice-making tray that is rotatably coupled to the ice-making case and rotatable about a rotation axis to an ice separation position and an ice generation position, and a cold air guide extending below the ice-making tray and configured to form a cold air flow path between a bottom surface of the ice-making tray and the cold air guide to guide cold air along a direction in which the rotation axis extends, the cold air guide being deformable and restorable and fixed to the ice-making tray;

a dispenser on the refrigerating compartment door to dispense ice from the ice maker;

an auxiliary door disposed in front of the refrigerating compartment door and configured to open and to close the ice-making compartment, and having an opening corresponding to the dispenser so that the dispenser is accessible through the opening while the auxiliary door is closed; and a cold air duct to connect the ice-making compartment to the freezing compartment so that air from the freezing compartment having a lower temperature than air from the refrigerating compartment flows to the ice-making compartment to cool the ice-making compartment, wherein the cold air guide is configured to contact the ice-making case so as to be deformed by the ice-making case when the ice-making tray is rotated to the ice separation position and to remain in contact with the ice-making case in a deformed state while in the ice separation position, and configured to be restored from the deformed state when the ice-making tray is rotated to the ice generation position.

2. The refrigerator of claim 1, wherein the cold air guide guides the air from the freezing compartment along the cold air flow path.

3. The refrigerator of claim 1, wherein the ice maker further includes a driver disposed at an end of the ice-making case and configured to rotate the ice-making tray to the ice separation position and the ice generation position, wherein the ice-making case includes an inlet cover formed at an end of the ice-making case opposite to the end at which the driver is disposed.

4. The refrigerator of claim 3, wherein the inlet cover is configured to guide the air flowing from the freezing compartment from the cold air duct to the cold air flow path.

5. The refrigerator of claim 3, wherein the inlet cover is disposed to face an inlet of the cold air flow path.

6. The refrigerator of claim 3, further comprising:

a connector located in the ice-making compartment and connecting the cold air duct to the inlet cover, and a seal provided on at least one end portion of the connector.

7. The refrigerator of claim 1, wherein the ice maker includes a temperature sensor device disposed at an end of the ice-making tray that is opposite to one end at which an inlet of the cold air flow path is disposed.

8. The refrigerator of claim 7, wherein the temperature sensor device includes a temperature sensor and a heat insulating cover provided to cover the temperature sensor.

9. The refrigerator of claim 8, wherein the ice-making tray is provided so that an ice-making cell positioned in an area at which the temperature sensor is mounted has a height smaller than a height of another ice-making cell.

10. The refrigerator of claim 9, wherein when the temperature sensor is mounted on the ice-making trav, a bottom surface of the temperature sensor is parallel to a bottom surface of the another ice-making cell.

11. The refrigerator of claim 1, wherein the cold air guide includes a shape retaining portion extending vertically from a rotation axis of the ice-making tray.

12. The refrigerator of claim 1, wherein the cold air guide includes a guide coupling portion configured to be coupled to the ice-making tray, the ice-making tray includes a tray coupling portion configured to be coupled to the guide coupling portion, and when the cold air guide is coupled to the ice-making tray, the guide coupling portion and the tray coupling portion are located at a farther distance away from a rotation axis of the ice-making tray than an ice-making cell of the ice-making tray.

13. The refrigerator of claim 12, wherein the tray coupling portion includes a tray coupling hole into which the guide coupling portion is inserted and fixed.

14. A refrigerator comprising:

a main body having a refrigerating compartment and a freezing compartment;

a refrigerating compartment door rotatably coupled to the main body to open and to close at least a part of the refrigerating compartment;

an ice-making compartment formed on a front surface of the refrigerating compartment door so that the ice-making compartment is accessible while the refrigerating compartment door is closed;

an ice maker, disposed in the ice-making compartment, to make ice and including an ice-making case, an ice-making tray that is rotatably coupled to the ice-making case and rotatable about a rotation axis to an ice separation position and an ice generation position, and a cold air guide coupled to the ice-making tray and extending below the ice-making tray to form a cold air flow path between a bottom surface of the ice-making tray and the cold air guide along an extension direction of the rotation axis, to guide cold air from the freezing compartment along the cold air flow path, wherein the cold air guide is configured to contact the ice-making case so as to be deformed by the ice-making case when the ice-making tray is rotated to the ice separation position and to remain in contact with the ice-making case in a deformed state while in the ice separation position, and to be restored from the deformed state when the ice-making tray is rotated to the ice generation position.

15. The refrigerator of claim 14, wherein the cold air guide is fixed to the ice-making tray so that the cold air guide does not interfere with discharge of ice from the ice-making tray when the ice-making tray is in the ice separation position.

16. The refrigerator of claim 14, wherein the cold air guide includes a shape retaining portion protruding toward the ice-making tray.

17. The refrigerator of claim 14, wherein the ice-making compartment is formed with a cold air supply hole through which air from the freezing compartment is supplied, the ice maker includes a temperature sensor device coupled to an ice-making cell located at an end portion of the ice-making tray that is distant from the cold air supply hole, and the temperature sensor device has a bottom surface provided to be parallel to a bottom surface of another ice-making cell of the ice-making tray.

* * * * *